US006425534B2

(12) United States Patent
Ketcham et al.

(10) Patent No.: US 6,425,534 B2
(45) Date of Patent: Jul. 30, 2002

(54) SPRAYING APPARATUS HAVING A SEALING MEMBER WITH APERTURES

(75) Inventors: Craig S. Ketcham, Somerset, PA (US); Mark Maclean-Blevins, Westminster, MD (US)

(73) Assignee: Green Garden Products Company, Bedford, PA (US)

( * ) Notice: Subject to any disclaimer, the term of this patent is extended or adjusted under 35 U.S.C. 154(b) by 0 days.

(21) Appl. No.: 09/244,392

(22) Filed: Feb. 4, 1999

Related U.S. Application Data

(60) Provisional application No. 60/107,156, filed on Nov. 5, 1998.

(51) Int. Cl.[7] ..... B05B 7/26

(52) U.S. Cl. ..... 239/316; 239/310; 239/317; 239/304; 239/305; 137/893; 251/206

(58) Field of Search ..... 239/310, 316, 239/317, 318, 304, 305, 307, 327; 137/205.5, 564.5, 268, 889, 893; 251/206, 250

(56) References Cited

U.S. PATENT DOCUMENTS

| | | | | | |
|---|---|---|---|---|---|
| 260,829 | A | * | 7/1882 | Bradley | 251/250 |
| 2,719,704 | A | * | 10/1955 | Anderson et al. | 239/318 |
| 2,780,232 | A | * | 2/1957 | Ney | 251/206 |
| 2,788,244 | A | * | 4/1957 | Gilmour | 251/206 |
| 3,255,972 | A | * | 6/1966 | Hultgren et al. | 239/318 |
| 3,381,899 | A | | 5/1968 | Forsman | |
| 3,770,205 | A | | 11/1973 | Proctor et al. | |
| 4,369,921 | A | | 1/1983 | Beiswenger et al. | |
| 4,446,887 | A | * | 5/1984 | Redmon et al. | 251/206 |
| 4,475,689 | A | | 10/1984 | Hauger et al. | |
| 4,736,891 | A | | 4/1988 | Chow et al. | |
| 4,750,674 | A | | 6/1988 | Chow et al. | |
| 4,901,923 | A | * | 2/1990 | McRoskey et al. | 239/310 |
| 5,007,588 | A | | 4/1991 | Chow et al. | |
| 5,039,016 | A | | 8/1991 | Gunzel, Jr. et al. | |
| 5,100,059 | A | | 3/1992 | Englhard et al. | |
| 5,320,288 | A | * | 6/1994 | Ketcham, Jr. | 239/310 |
| 5,372,310 | A | | 12/1994 | Ketcham | |
| 5,383,603 | A | | 1/1995 | Englhard et al. | |
| 5,799,831 | A | * | 9/1998 | Spriggs et al. | 137/889 |

* cited by examiner

*Primary Examiner*—William C. Doerrler
*Assistant Examiner*—Christopher S. Kim
(74) *Attorney, Agent, or Firm*—Reed Smith LLP

(57) ABSTRACT

A sprayer head is provided for attachment to a container containing a chemical product to be diluted by a carrier stream. The sprayer head includes a hose attachment member having structure for attaching the sprayer head to a source of the carrier stream. The sprayer head also includes a cap member, including structure for attaching the sprayer head to the container and a control mechanism movably connected to the cap member for controlling fluid communication between the cap member and the container. The control mechanism can be either reciprocated or rotated so that the sprayer head can be used either to spray a low viscosity liquid product in varying dilutions or to dilute and spray a mixture of high viscosity liquid, gelatinous or powdered product and carrier stream fluid. The control mechanism includes a seal member having product apertures of increasing sizes for controlling the varying dilutions.

7 Claims, 11 Drawing Sheets

SPRAYING APPARATUS HAVING A SEALING MEMBER WITH APERTURES

This application claims benefit to U.S. provisional application Ser. No. 60/107,156 filed Nov. 5, 1998.

FIELD OF THE INVENTION

The present invention relates to a spraying apparatus and especially to a multipurpose spraying apparatus having a sealing member incorporating selectable product apertures into the sealing member itself.

BACKGROUND OF THE INVENTION

Liquid aspirators are commonly employed to apply diluted solutions containing chemicals such as pesticides, fungicides, herbicides, and fertilizers to lawns or garden foliage. Such aspirators are also commonly used to dispense detergents (including liquid, gelatinous and dry detergents). There are two general types of sprayers that are employed for these functions, those that use concentrated liquid chemical solutions of various viscosities, and those that utilize gelatinous substances or powdered dry chemicals. Typically, both types of sprayers are attached to a garden hose.

In the case of the liquid chemical aspiration sprayer, the pressure of the water delivered by the hose through the sprayer creates a negative pressure gradient or venturi that causes the chemical solution to be aspirated into the water stream, thereby providing a diluted solution to be sprayed.

U.S. Pat. No. 4,901,923, for example, discloses a variable dilution ratio hose-end aspirator sprayer. The sprayer comprises a container for housing the liquid to be mixed with the water and a mixing head having a nozzle at one end thereof and a garden hose attachment device at the other end thereof. The sprayer also includes a mixing chamber within the mixing head, a hose for communicating the liquid from the container to the mixing head and a disk having a plurality of apertures therein rotatably mounted in the mixing head to control flow from the container to the mixing chamber. A flow tube communicates liquid in the container to the inlet in the mixing chamber through a selected aperture in the disk so that the liquid is diluted with pressurized water at a dilution ratio determined by the size of the aperture aligned with the tube and the mixing chamber. The sprayer also includes a cleaning orifice positioned circumferential from the mixing chamber so that each aperture of the disk may be selectively aligned with the cleaning orifice for cleaning.

U.S. Pat. No. 5,039,016 also discloses an aspiration-type chemical sprayer for dispensing small quantities of a liquid-based chemical into a stream of carrier fluid. The sprayer includes a sprayer head assembly sealingly mounted onto a container for storing the chemical to be disbursed. The sprayer head assembly also includes a multifunction unitary valve for providing a range of aspiration rates simultaneously with full communication of the container interior to atmospheric pressure. The valve may also include means for positive and simultaneous closure of the aspiration and vent passages so as to seal the chemical in the container when the sprayer is not in use.

U.S. Pat. No. 5,100,059 similarly discloses an aspiration-type chemical sprayer including a sprayer head assembly sealingly mounted onto a container holding chemicals such as pesticides or fertilizers. A unitary valve in the sprayer head assembly controls carrier fluid flow from a pressurized source of water while simultaneously providing a controlled aspiration rate and full communication of the container interior to atmospheric pressure. The valve additionally includes simultaneous closure of the carrier fluid, aspiration and vent passage ways so as to seal the chemical in the container when the sprayer is not being used.

In general, the liquid chemical aspiration sprayers include a container for holding the chemical solution to be diluted and sprayed and a sprayer/mixing head. The base portion of the sprayer head serves as a cover for the chemical container. Such sprayer heads generally include an adapter for connecting the sprayer head to a standard garden hose, and a hand valve for turning on and off the flow of water from the garden hose. The sprayer head also includes an aperture over which water from the garden hose passes to mix with undiluted chemical solution from the container. Such sprayer heads may also include a venturi chamber in which the water from the garden hose mixes with the chemical from the container.

In principle, as water passes over the aperture or through the venturi chamber, a siphoning or vacuum action is created by virtue of the velocity of the water passing over the aperture or through the chamber, to draw chemical from the container into the water stream for dilution. The basis of operation of these sprayers is, in closed venturi type systems, Bernoulli's principle. And, in aspiration type sprayers open to the atmosphere, the principle under which product is drawn from the container is known as the Kuanda effect.

Liquid chemical aspiration sprayers are of two general types . Many of these sprayers have a fixed, nonadjustable dilution ratio. However, other commercially available liquid chemical aspiration sprayers provide for multiple dilution ratios. These multiple dilution ratio sprayers generally do not require chemical premixing and directly provide the desired concentration of liquid chemical into the carrier stream. The variation in the dilution ratios is generally provided in these sprayers by either varying the size of the opening of the passageway between the chemical container to the mixing chamber, or by varying the size of the vent opening which allows air into the mixing chamber in order to control the level of vacuum and the resulting siphoning action on the liquid chemical from the container. In both types of multiple dilution sprayers, a rotatable w heel or slideable stem, which incorporates orifices of various sizes, is interposed in the passageway or the vent opening and is used to select the appropriate dilution ratio.

Sprayers that are to be used for wettable chemical powders also utilize the same basic container sprayer/mixing head design as liquid chemical aspiration sprayers. But, when the water delivered from the hose enters the sprayer/mixing head, a portion of that stream is directed into the container to dissolve and dilute the wettable chemical powder therein. once diluted, the product solution enters that portion of the water stream pressure gradient described above and by displacement of the solution within the container by incoming water.

U.S. Pat. No. 5,007,588 also discloses an aspiration-type sprayer comprising a sprayer head which is permanently attachable to a container in which additive material is received. The sprayer head may be moveable between positions controlling the degree of aspiration affected, and is provided with a cap moveable between a first position in which the cap seals the container and prevents the additive material from escaping therefrom and a second position in which the container is unsealed and aspiration of the contents thereof can take place. Elements may be provided as part of the sprayer assembly for controlling the flow of the aspirating fluid. The cap is secured in its sealing position by an element which requires special manipulating for release, thereby providing an important safety feature.

U.S. Pat. Nos. 5,320,288 and 5,372,310 each disclose an aspiration-type sprayer that is attached to a product container. This sprayer includes a control mechanism for simultaneously controlling the flow of the carrier stream through the nozzle and the chemical product. This sprayer provides the ability to spray both the chemical solution and pure carrier fluid, as well as the ability to be placed in a sealed "off" position. More particularly, the means for controlling the flow of carrier fluid can be opened while the chemical product is sealed within the container. In this sprayer, the product channel is both substantially linear and substantially reduced in length.

U.S. Pat. Nos. 5,320,288 and 5,372,310 also disclose a means to dispense a soluble solid chemical or a wettable powder. The control mechanism can be slid into a position where a portion of the carrier stream is diverted into the container to dilute the dry chemical. The resulting chemical solution then exits the container via a product channel and is placed back into the non-diverted portion of the carrier stream, again under the influence of the aforementioned negative pressure gradient and displacement with incoming water.

Typically, in the above-described sprayers, including the apparatus described in U.S. Pat. Nos. 5,230,288 and 5,372,310, product flows through one or more apertures in the valve or apparatus body and/or selection element. The selection element may be connectively engaged to the valve body. The connection between the selection element and the valve body must be airtight in order to provide a vacuum necessary for aspiration. In order to provide the airtight seal, a separate sealing means is generally provided in the form of a gasket, membrane or o-rings.

Additionally, a common problem associated with sprayer application devices, small apertures have a tendency to become clogged or blocked by debris in the material being diluted. Commonly, this is overcome, by a user probing the aperture to eliminate the blockage or by the use of a filter screen at the beginning of the product flow passages. In both instances, the effect is essentially undesirable due to potential damage to the product and additional costs. It is noted that some application devices do not allow access to the apertures for cleaning, rendering a clogged device a faulty device.

An advantage exists, therefore, for a sealing and selection member for any type of application and/or mixing system that incorporates the selectable product apertures directly into the sealing element itself. This would allow the use of fixed apertures in the valve body itself in a preferred diameter to insure proper tolerances are met for optimal performance of the aspiration principal.

Another advantage exists for a sealing member formed from an elastomeric material which would allow apertures of a diagonal or less than linear nature.

Another advantage exists for an application device having apertures which are self-cleaning.

A further advantage exists for a multi-function spraying application device which can spray simultaneously from two separate containers.

Finally, an advantage exists for a sealing member which includes product apertures having a broad range of sealing applications.

SUMMARY OF INVENTION

Accordingly, the preferred embodiment of the present invention provides an aspiration type sprayer head for attachment to a container containing either a liquid or dry chemical product to be diluted by a carrier stream. The sprayer comprises a cap member having means for attaching the cap member to a source of the carrier stream and means for attaching the cap member to the container.

The cap member further includes a carrier stream flow passage, outlet means communicable with the carrier stream flow passage for delivering product from the container to the carrier stream flow passage, and inlet means communicable with the carrier stream flow passage and an ambient atmosphere for delivering a selected one of a portion of the carrier stream fluid and ambient air to the container. A valve element is slidable between "ON" and "OFF" positions to control carrier stream flow through the carrier stream passage.

The sprayer head further comprises control means movably connected to the cap member for controlling fluid communication between the cap member and the container. The control means comprises a seal member having at least one product aperture and preferably a plurality of product apertures of different aperture sizes communicable with the outlet means of the cap member for delivering product from the container to the carrier stream flow passage, and may also comprise one or more carrier stream inlet ports communicable with the carrier stream flow passage and the inlet means of the cap member and/or one or more vent channels communicating with atmospheric air. The control means is selectively disposable into a plurality of positions with respect to said cap member.

According to a first presently preferred embodiment conducive to spraying liquid product, when the control means is placed into one of a plurality of "first positions" with respect to the cap member, the inlet means of the cap member communicates with the ambient atmosphere and delivers ambient air to the container. Simultaneously, one of the plurality of product apertures communicates with the outlet means of the cap member and the carrier stream flow passage. With the control means so disposed, undiluted liquid product is drawn from the container and diluted by the carrier stream in the carrier stream flow passage and diluted product is discharged from the sprayer head at a first preselected dilution ratio while ambient air displaces product drawn from the container. When the control means is placed into another of the plurality of first positions with respect to the cap member, another one of the plurality of product apertures having a different aperture size is brought into alignment with the outlet means of the cap member and the carrier stream flow passage. Under these circumstances, product is drawn from the container and diluted by the carrier stream in the carrier stream flow passage and diluted product is discharged from the sprayer head at another preselected dilution ratio different from the first preselected dilution ratio. In addition, the control means may be disposed into other positions whereby only carrier stream is dispensed by the apparatus or the apparatus is sealed as to all fluid flow.

In accordance with a further presently preferred embodiment suitable for spraying powdered product, highly viscous liquid product or gelatinous substances, when the control means is placed into one of a plurality of "first positions" with respect to the cap member, one of a plurality of carrier stream inlet ports communicates with the carrier stream flow passage and the inlet means of the cap member and delivers a portion of the carrier stream to the container. Concurrently, one of the plurality of the product apertures communicates with the outlet means of the cap member and the carrier stream flow passage. With the control means in this disposition, the portion of the carrier stream delivered to the container mixes with the product and the mixed carrier stream and product is drawn from the container and diluted by the carrier stream in the carrier stream flow passage at a first preselected dilution ratio whereupon the diluted carrier stream and product mixture is discharged from the sprayer head. When the control means is placed into another of the plurality of first positions with respect to the cap member, another carrier stream inlet port is brought into communication with the carrier stream flow passage and the inlet means of the cap member while another one of the plurality of product apertures having a different aperture size is brought into alignment with the outlet means of the cap member and the carrier stream flow passage. Accordingly, carrier stream is again delivered to the container and mixes with the product and mixed carrier stream and product is drawn from the container and diluted by the carrier stream in the carrier stream flow passage and diluted product is discharged from the sprayer head at another preselected dilution ratio different from the first preselected dilution ratio. Again, the control means may also be disposed into other positions whereby only carrier stream fluid is dispensed by the apparatus or the apparatus is sealed as to all fluid flow.

According to a further preferred embodiment wherein the sprayer is adapted to spray either liquid or dry product, when the control means is placed into one of a plurality of "first positions" with respect to the cap member, the inlet means of the cap member communicates with the ambient atmosphere and delivers ambient air to the container and one of the plurality of product apertures communicates with the outlet means of the cap member and the carrier stream flow passage, whereby undiluted liquid product is drawn from the container and diluted by the carrier stream in the carrier stream flow passage and diluted product is discharged from the sprayer head while ambient air displaces product drawn from the container. Likewise, when the control means is disposed into another of the first positions, a different dilution ratio of the liquid product may be effectuated.

When the control means is placed into one of a plurality of "second positions" with respect to the cap member, one of the plurality of carrier stream inlet ports communicates with the carrier stream flow passage and the inlet means of the cap member and delivers a portion of the carrier stream to the container. At the same time, another of the plurality of dry powdered product within the container apertures communicates with the outlet means of the cap member and the carrier stream flow passage, whereby the portion of the carrier stream delivered to the container mixes with dry powder, viscous liquid or gelatinous product, within the container and the mixed carrier stream and product is drawn from the container and diluted by the carrier stream in the carrier stream flow passage whereupon the diluted carrier stream and product mixture is discharged from the sprayer head. As should be apparent, when the control means is placed into another of the second positions, the product may be dispensed by the sprayer at a different dilution ratio.

When placed into a third position with respect to said cap member, the control means prevents communication between said carrier stream flow passage and both the inlet means and the outlet means of the cap member, whereby only carrier stream fluid is discharged from the sprayer head. Or, in the case when carrier stream flow is terminated, sealing the container openings.

The control means may assume the form of a reciprocable plate slidingly connected to the cap member or a rotatable disk rotatably connected thereto or any number of configurations. The plurality of product apertures preferably includes at least a first set of product apertures of varying sizes for dispensing a mixture of carrier stream fluid and either liquid or dry product from the container at various dilution ratios. Alternatively, the plurality of product apertures may also include a second set of product apertures of varying sizes. In such case, a user may selectively dispense liquid product from one container at various dilution ratios through one of the first and seconds sets of product apertures. The user may then reuse the liquid product container or replace same with a container holding powdered solid highly viscous liquid or gelatinous product. Thereafter, the user may manipulate the control means such that the sprayer apparatus dispenses product through the other or both of the first and second sets of product apertures to achieve variable dilution ratios of product to be discharged.

The present invention further provides a sealing and selection member for any type of application and/or mixing system that incorporates the selectable product apertures directly into the sealing element itself. This would allow the use of fixed apertures in the valve body itself in a preferred diameter to insure proper tolerances are met for optimal performance of the aspiration principal.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments therefor shown, by way of example only, in the accompanying drawings, wherein.

DETAILED DESCRIPTION OF THE INVENTION

Figure 1:
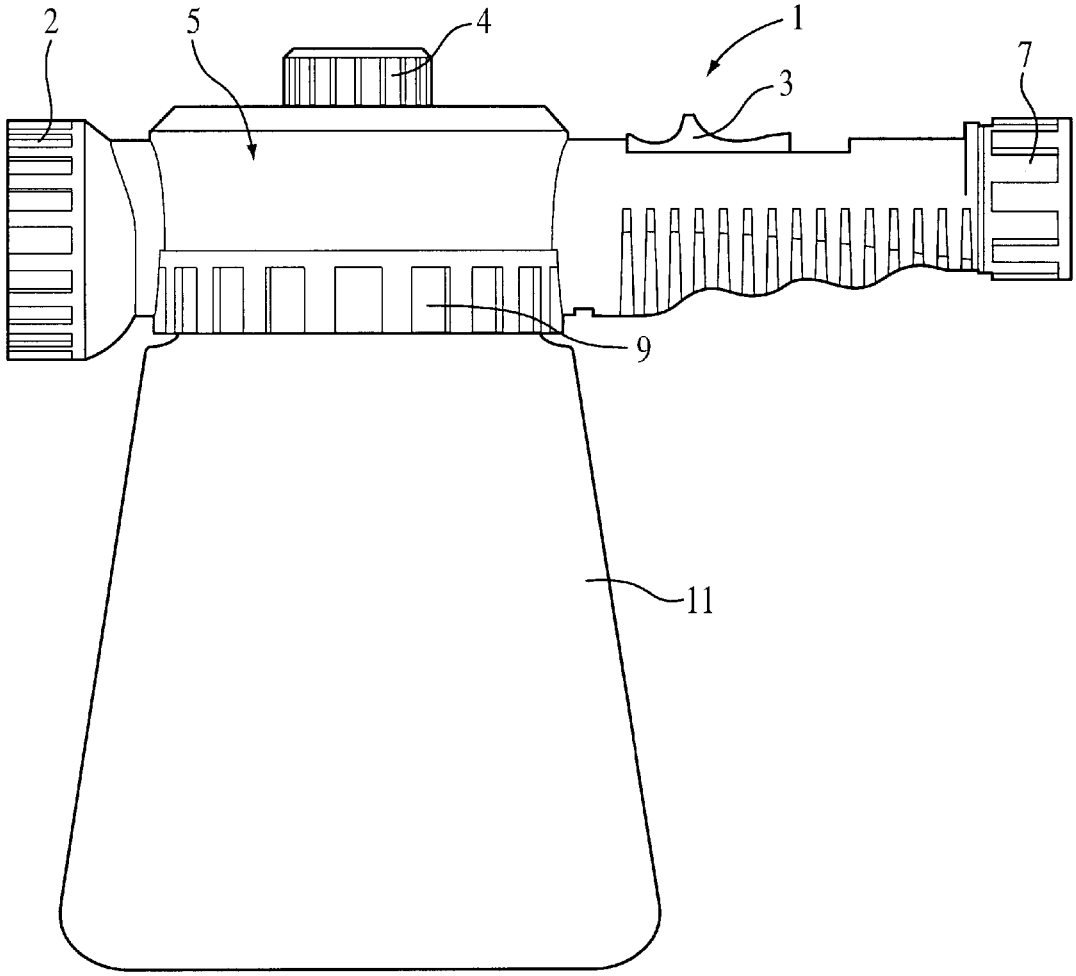
FIG. 1 is a side view of the sprayer apparatus of the present invention.
Figure 2:
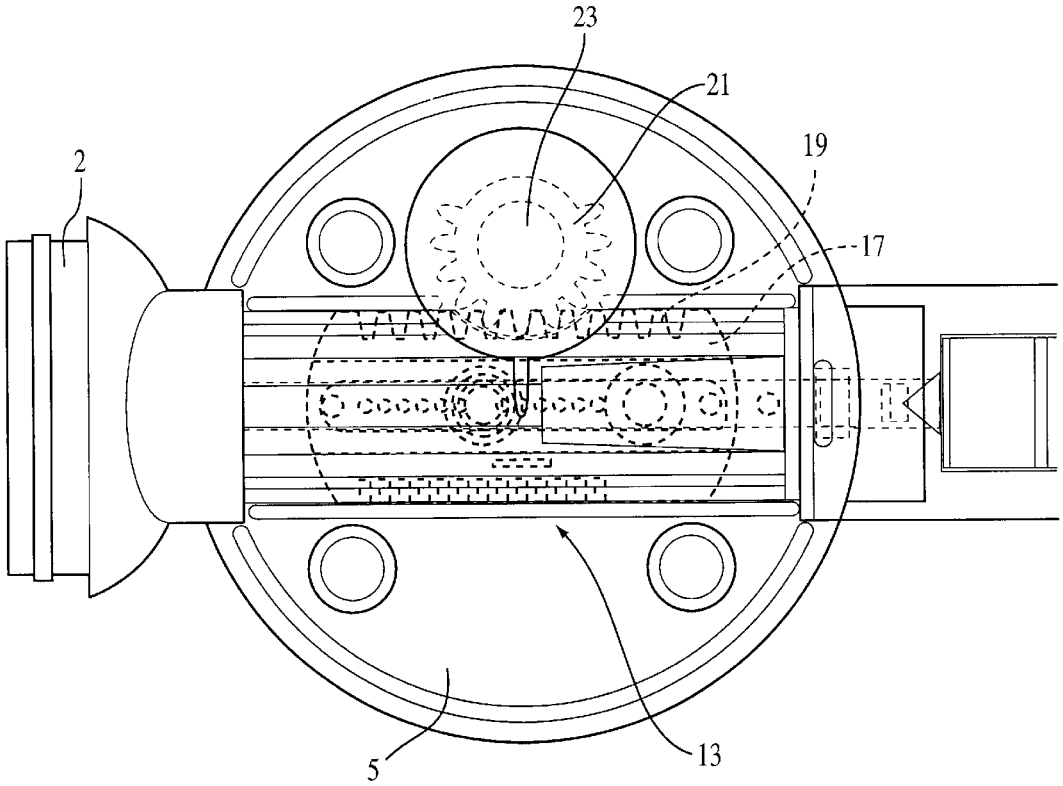
FIG. 2 is a partial top view of the sprayer apparatus according to a preferred embodiment of the present invention.

Referring to the drawings wherein like reference characters designate like or corresponding parts throughout the several views, there is shown in FIG. 1 a sprayer apparatus constructed in accordance with a first presently preferred embodiment of the invention. The sprayer apparatus includes a sprayer head or housing 1 formed of rigid material such as metal or, more preferably, plastic and generally comprised of a cap member 5 having hose attachment means 7 and container attachment means 9. Hose attachment means 7 is typically an internally threaded member removably attachable to a hose end (not shown) for supply of a carrier stream of pressurized fluid to the cap member 5. In most applications, it is contemplated that the carrier stream fluid will be water supplied by a common garden hose (not shown). Alternatively, it is contemplated that the sprayer apparatus may be used in commercial or industrial applications with sources of carriers streams other than water, such as other liquids including chemical solvents or gaseous fluids such as air. Container attachment means 9 which may assume the form of any suitable connecting structure, e.g., threading, snaps or the like, for permanent or releasable sealing attachment of the cap member to a product container 11, the interior of which is capable of holding a chemical product to be diluted and sprayed. The chemical product can be either a liquid or a powdered solid.

Figure 6:
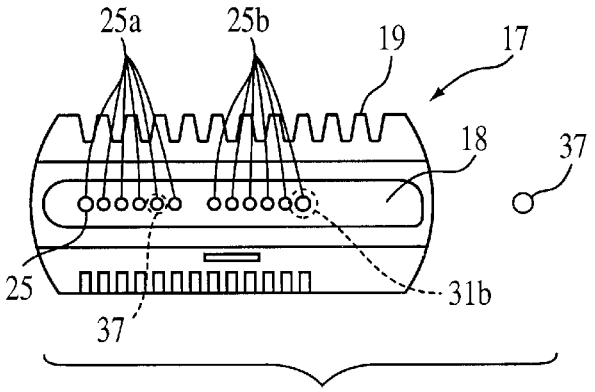
FIG. 6 is a top view of the control plate of FIG. 3A.
Figure 7:
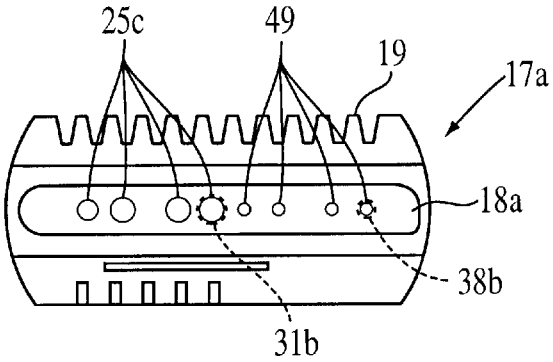
FIG. 7 is a top view of the control plate of FIG. 4A
Figure 8:
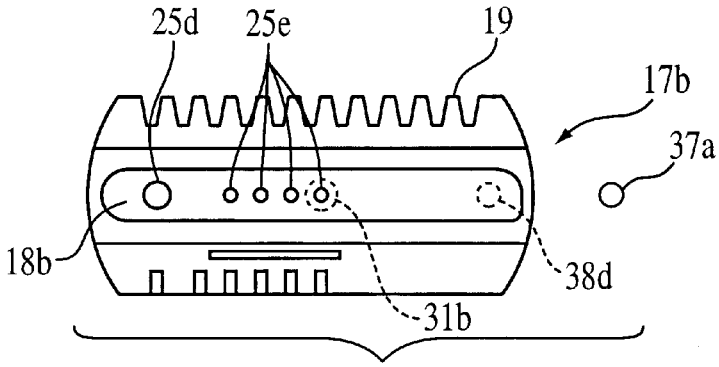
FIG. 8 is a top view of the control plate of FIG. 5A.
Figure 10:
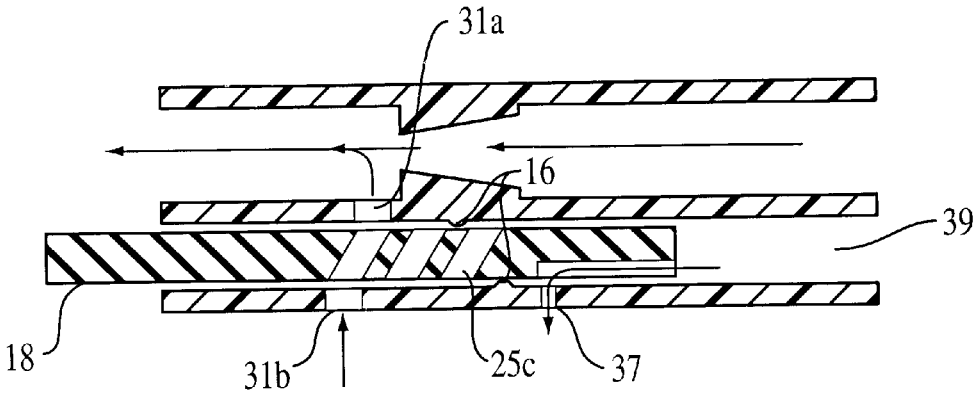
FIGS. 10–12 are a cross-sectional views of alternate embodiments of the present invention.
Figure 11:
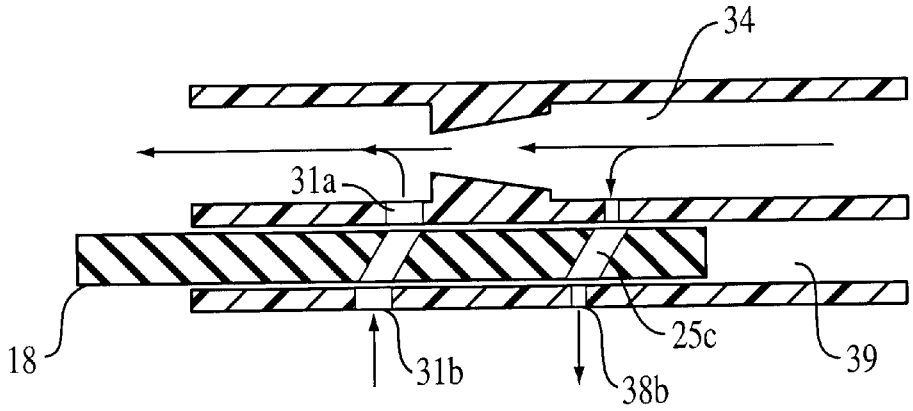
Figure 13:
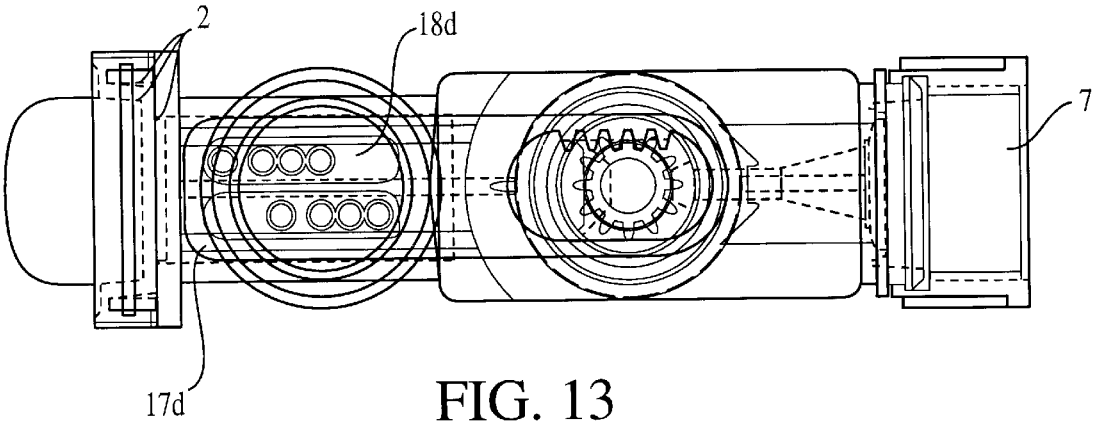
FIG. 13 is a top view of an alternate embodiment of the present invention.
Figure 14:
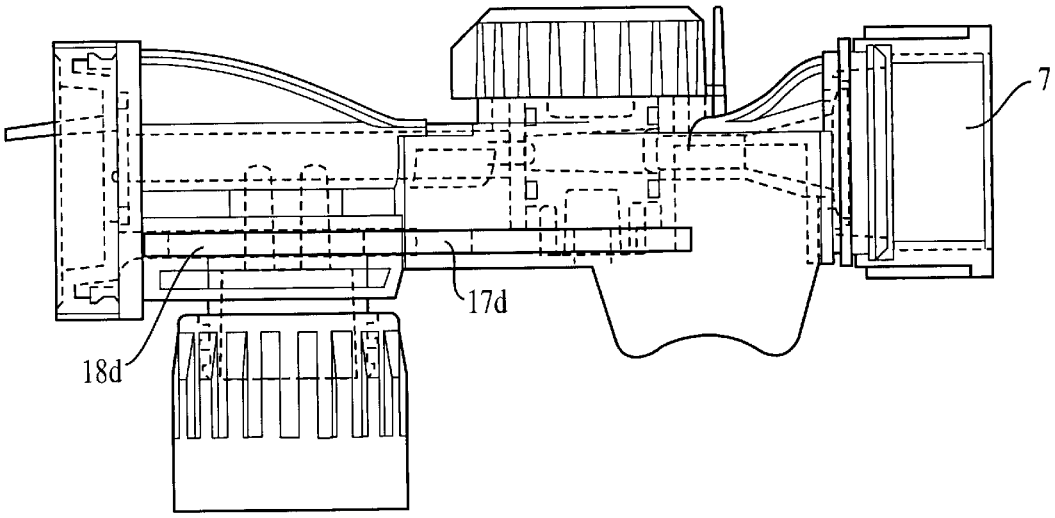
FIG. 14 is a side view of an alternate embodiment of the present invention depicted in FIG. 13.
Figure 15:
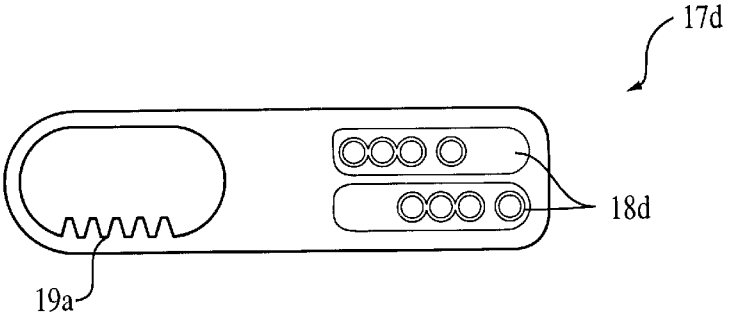
FIG. 15 is a top view of the control plate of the embodiment of FIGS. 13–14.

Cap member 5 further includes a control means 13 (FIG. 2)which is disposed generally above container attachment means 9. According to a first preferred embodiment, as illustrated in FIGS. 6–8, control means 13 includes a reciprocable and longitudinally slideable control plate 17. The slideable control plate 17 is desirably provided with a toothed rack 19. Control means 13 further comprises a toothed gear wheel 21 in operative engagement with the toothed rack 19. The gear wheel 21 in turn may be integrally connected to a hand-manipulable control knob 4 or similar actuator by a shaft 23. Preferably, a ball valve or other suitable flow control valve element 24 regulates the flow of a carrier stream through the cap member and is operable by a longitudinally slideable actuator 3. When the user turns the actuator, the resulting rotation of the gear wheel 21 causes the slideable control plate 17 to slide longitudinally and reciprocate in either a fore or aft direction with respect to the cap member 5. Although illustrated as being operable in a substantially vertical plane, it is also contemplated that shaft 23 may alternatively be disposed substantially horizontally with respect to the cap member 5. It will be understood, that other suitable means such as a simple lever extending from the control plate through the cap member which may be slid back and forth by the user may achieve the same results as gear wheel 21 and toothed rack 19. In the embodiments illustrated in FIGS. 2–8 the slideable control plate is provided with a toothed rack 19 on one side. Alternatively, the toothed rack may be positioned on a posterior or anterior end of the slideable control plate or interiorly of the control plate (FIGS. 13–15.) Slideable control plate 17 is desirably constructed with a substantially oblong portion defining an opening into which a suitably dimensioned seal member 18 may be permanently or, more desirably, releasably sealed. Seal member 18 is provided with appropriate product apertures 25. According to a presently preferred construction and as illustrated in FIGS. 2–8, the seal member 18 is formed or molded from an elastomeric material such as a natural or artificial rubber, neoprene, polyethylene or the like. Also, as illustrated in FIGS. 10 and 11, formation from an elastomeric material may allow the seal member to be constructed with diagonal or less than vertical apertures 25C. Advantage of this is diagonal apertures allow more flexibility in design configurations. Less preferably, the seal member may be formed from a nonelastomeric material, as long as the material is able to form the proper seal necessary between the cap member and the product container.

Figure 12:
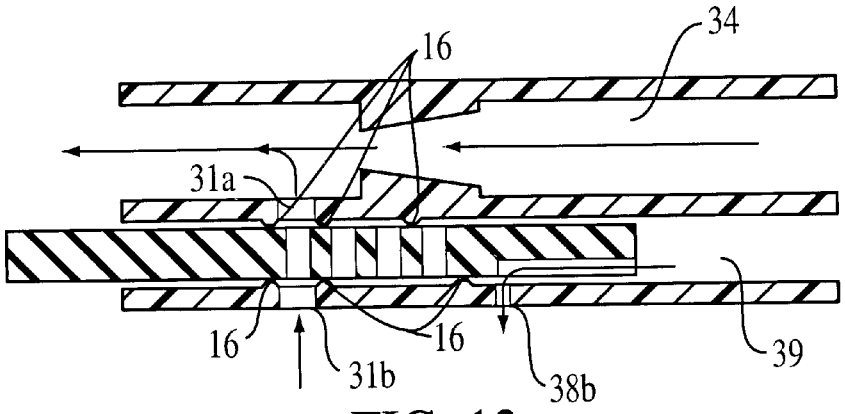

At least one and desirable both, surfaces of the cap member contacting upper and lower surfaces of the seal member (the lower surface of the nozzle and the upper surface of the container attachment means 9) include raised areas 16 which compressively engage the upper and lower surface of the seal member (FIGS. 10 and 12). As the seal member is moved across the raised areas 16, the apertures 25 or 25*c* in the sealing member are compressed longitudinally as well as laterally. This massaging action works loose any debris or blockage that may occur.

The container outlet means may suitably comprise, as illustrated, a pair of cooperating upper and lower container outlet ports 31*a* and 31*b*. The upper port 31*a* is adapted for fluid communication with an anterior portion 33 (hereinafter anterior flow passage 33) of a carrier stream flow passage 34 of a nozzle portion of cap member 5 and the lower port 31*b* is connected to the upper end of a product delivery tube 35 which extends downwardly into the internal cavity of container 11.

Figure 3A:
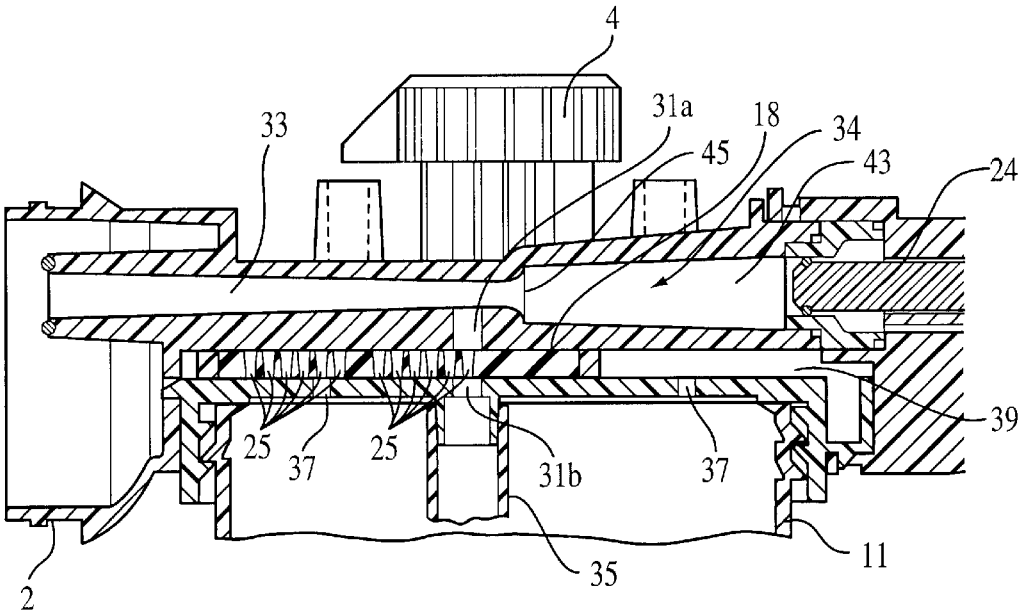
FIGS. 3A, 3B and 3C are top views of a first preferred embodiment the sprayer apparatus of the present invention depicting a slideable control means in several positions associated with dispensing liquid product solution from the apparatus.

A first preferred embodiment of the apparatus comprises an apparatus for dispensing comparatively low viscosity liquid chemical is illustrated in FIGS. 3A–3C and 6. According to the first preferred embodiment, the forward portion of the slideable control plate 17 includes at least a first set of product apertures 25*a* and, more preferably, a second set of product apertures 25*b*, the functions of which are described in greater detail below. The apertures are preferably arranged in sets of linear arrays with successive product apertures of each set having a decreasing (or increasing) aperture size or diameter whereby increasingly larger product apertures will result in increasingly less diluted (i.e., more concentrated) flows of product being discharged from the sprayer apparatus, and vice versa. The arrangement of the product apertures will be described in greater detail below. When slideable control plate 17 is in a first position as shown in FIG. 3A, one of the product apertures 25 is aligned with outlet ports 31*a* and 31*b*. In addition, a later described vent channel 39 is established in the cap member 5. Through proper manipulation of the control plate 17, the vent channel 39 (which communicates with the ambient atmosphere) may permit atmospheric air to enter one inlet port 37 and thus the interior of the container 11 when any one of the first or second sets of product apertures is brought into alignment with outlet ports 31*a* and 31*b*.

In this first position shown in FIG. 3A (the "first position" referring generally to one of several orientations into which the slideable control member 17 may be selectively disposed in order to dispense comparatively low viscosity liquid chemical through a chosen one of the first or second sets product apertures 25*a*, 25*b* to effect a desired dilution ratio), water from a hose (not shown) flows through a posterior portion 43 (hereinafter posterior flow passage 43) of the carrier stream flow passage 34, through a flow passage constriction 45, and then through anterior flow passage 33. As the water passes through constriction 45 and the anterior passage 33, it passes over the selected product aperture of product aperture set 25*a* or 25*b* (25*b* in FIG. 3A) at high velocity, thereby creating a negative pressure gradient or venturi which causes liquid chemical product in the interior of the container 11 to be drawn under suction through the product delivery tube 35, the lower container outlet port 31*b*, the selected product aperture 25, and the upper container outlet port 31 where it may then enter the anterior flow passage 33. Once drawn into the anterior flow passage 33, the product is then diluted to the desired concentration by the carrier fluid stream passing through the anterior flow passage and is sprayed onto a target such as a residential lawn or garden, automobile, boat, building structural surface and the like.

When a selected product aperture 25 is properly disposed with respect to container outlet ports 31*a* and 31*b*, atmospheric air from vent channel 39 passes through one of the container inlet ports 37 and thus the container 11 to displace the discharged liquid chemical and prevent collapse of the walls of the container. The cap member 5 may also include, as is known in the art, a fixed or adjustable discharge nozzle 2 whereby fluid dispensed from the spray apparatus may be urged to assume a desired pattern of flow, e.g., thin stream, diffused spray and the like.

Figure 3B:
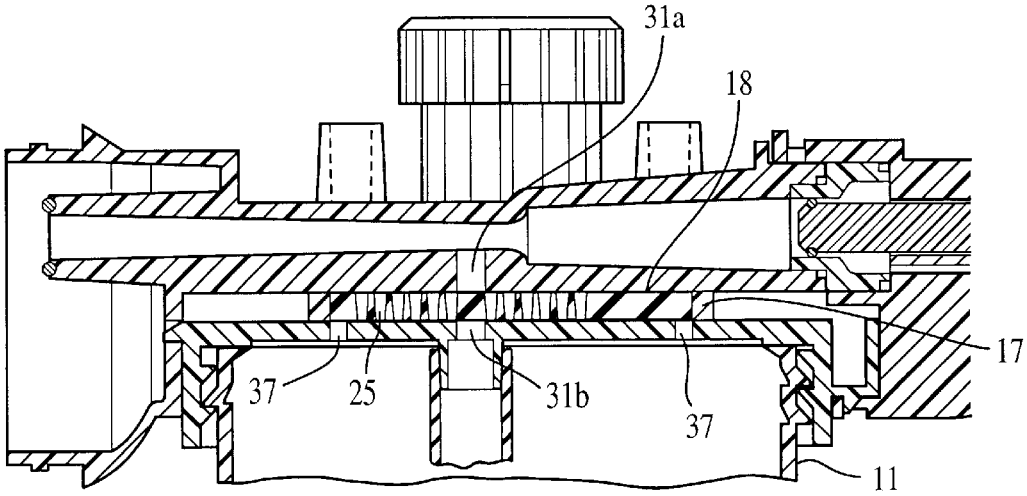

Turning to FIG. 3B, the control plate 17 is shown as it would be disposed in an "OFF" position and/or when a user desires to dispense only carrier stream fluid through the sprayer apparatus. In particular, the elongated seal member 18 of the control plate is positioned such that it covers and seals the container outlet port with a sealing area between the sets of apertures and the pair of inlet ports with sealing areas anteriorly and posteriorly of the sets of apertures. With the control plate 17 in this position, carrier stream fluid passes through the control valve 24 and the carrier stream flow passage 34 without interacting with the container 11 or its contents.

Figure 3C:
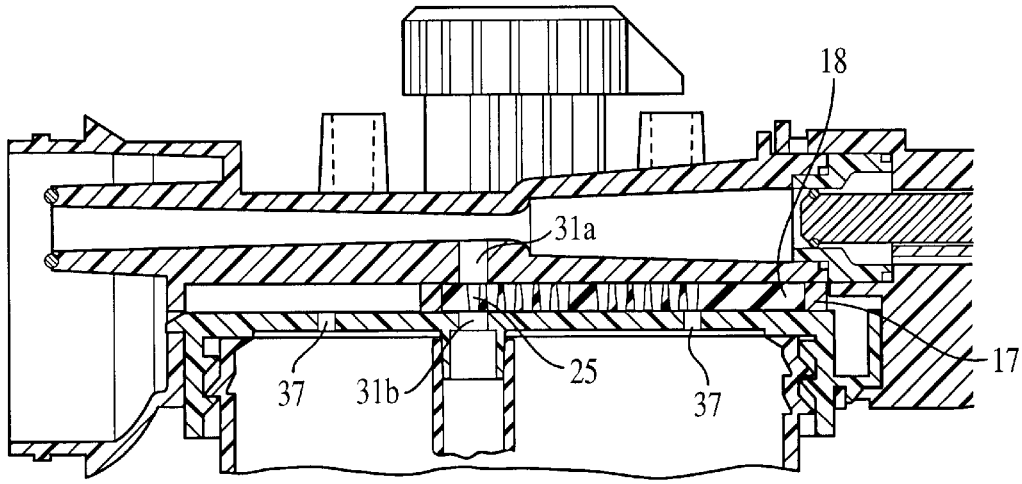

FIG. 3C is similar to FIG. 3A, however a selected product aperture from product aperture set 25*a* is disposed with respect to container outlet ports 31*a* and 31*b*.

Figure 4A:
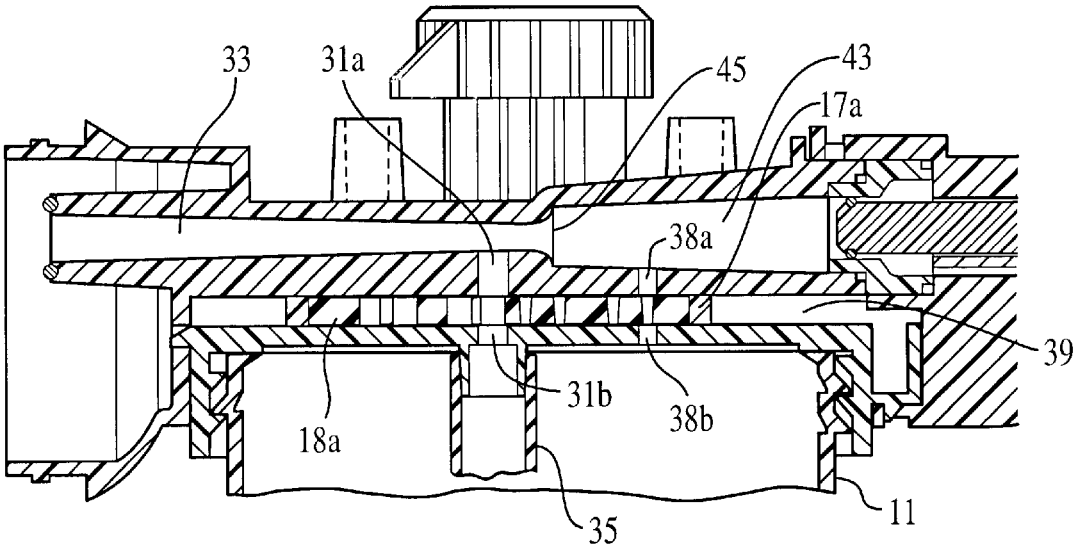
FIGS. 4A, 4B and 4C are top views of a further preferred embodiment the sprayer apparatus of the present invention depicting a slideable control means in several positions associated with dispensing powdered product from the apparatus.
Figure 4B:
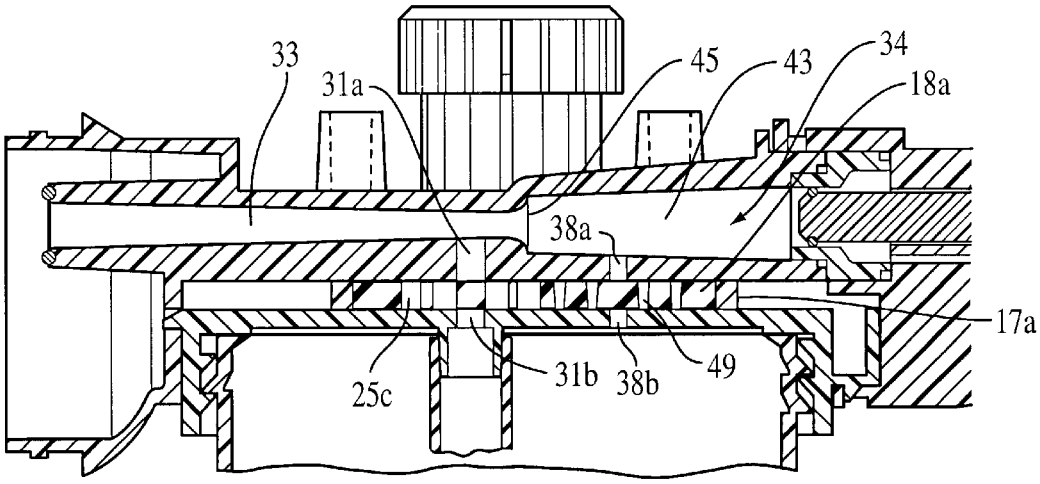
Figure 4C:
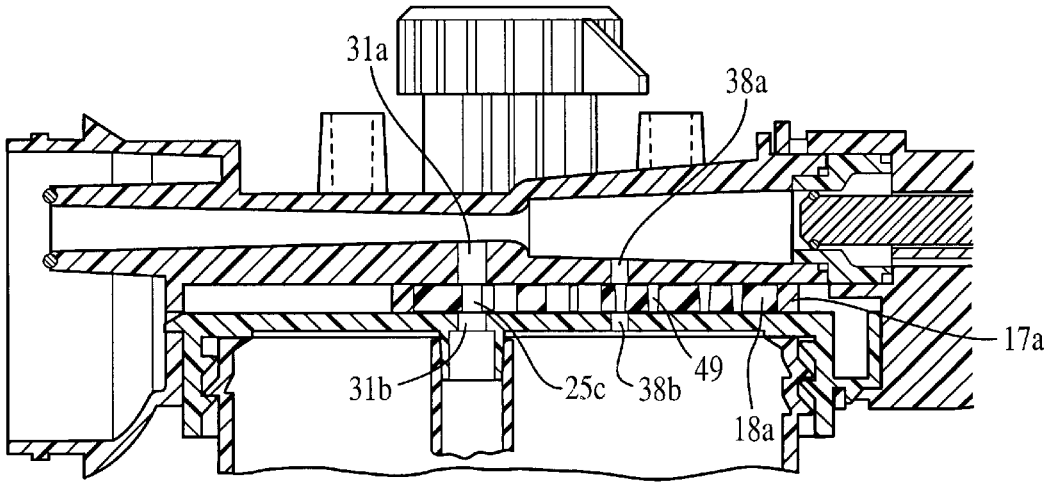

Referring to FIGS. 4A–4C there is shown a further preferred embodiment of the sprayer apparatus of the present invention. According to this particular embodiment, the slideable control member, herein designated by reference numeral 17*a*, is configured for selective disposition to dispense a mixture of carrier fluid and dissolved or suspended highly viscous liquid, gelatinous substance or dry powder product, through a chosen one of a set of product apertures 25*c* at one of several desired dilution ratios. As illustrated, slideable control plate 17*a* has been slid into a position such that one of the set of product apertures 25*c* is aligned with the container outlet ports 31*a* and 31*b*.

Simultaneously, a corresponding one of a set of carrier stream inlet ports 49 provided in the slideable control member is brought into alignment with corresponding container inlet ports 38*a* and 38*b* whereby a portion of the carrier stream in posterior flow passage 43 (by virtue of back-pressure created by the presence of flow passage constriction 45) is diverted through the appropriate carrier stream inlet port 49 and the container inlet ports 38*a* and 38*b* and into container 11. Once in the container, the carrier stream water mixes with the powdered chemical in the container 11, thereby forming a solution or a suspension. It will be appreciated that the carrier stream inlet ports 49 correspond in number and spacing to the product apertures 25*c*.

The undiverted remainder of the carrier stream water passes through the flow passage constriction 45 and through the anterior flow passage 33. Again, as the water passes through the anterior flow passage, it passes over the selected product aperture of the set of product apertures 25*c*, thereby creating a negative pressure gradient and causing the chemical solution in the interior of the container 11 to be drawn through product delivery tube 35, container outlet ports 31*a* and 31*b* and the selected product aperture 25*c* whereupon it is then diluted by the water stream in the anterior flow passage 33 and sprayed onto a suitable target. This effect, of course, is supplemented by diverted carrier stream fluid entering the container inlet ports 38*a* and 38*b* aligned with and the carrier stream inlet port 49 so as to displace the product solution exiting the container 11. By virtue of the construction of the control plate 17*a*, the vent channel 39 is at all times sealed from fluid communication with the lower container inlet port 38*b* by means of the lower surface of the control plate.

FIG. 4B illustrates an "OFF" position, "carrier stream only" setting of the sprayer apparatus. That is, the slideable control plate 17*a* may be moved into a position such that none of product aperture 25*c* and carrier stream inlet port 49 are in communicative connection with either the container outlet ports 31*a* and 31*b* or the container inlet ports 38*a* and 38*b*. In other words, the carrier stream flow passage 34 is sealed with respect to the container outlet ports 31*a* and 31*b* and the container inlet ports 38*a* and 38*b* by means of the elongated seal member 18*a*. The carrier stream fluid therefore passes directly through the posterior flow passage 43, the flow passage constriction 45, the anterior flow passage 33, and out of the sprayer without mixing with any product from the container 11. Substantially pure water is therefore sprayed without removing container 11. FIG. 4C, like FIG. 4A, reflects the positioning of another selected product aperture 25*c*.

A further preferred embodiment of the present invention is revealed in FIGS. 5A–5C and 8 in which either low viscosity liquid, high viscosity liquid, gelatinous substance or dry product may be dispensed using a single spraying apparatus. Similar in many respects to the apparatus described above in connection with FIGS. 3A–3C and 4A–4C, the sprayer apparatus shown in FIGS. 5A–5C a differs from its previously described counterparts a primarily in the construction of its slideable control plate, herein identified as reference numeral 17*b*. The slideable control plate 17*b* includes a first set of product apertures 25*d* and a second set of product apertures 25*e*, the functions of which are described below. Although each set of product apertures 25*d*, 25*e* may include but a single aperture, it is more desirable that they comprise a plurality of apertures to achieve multiple dilution ratios of liquid and dry chemicals that may be dispensed by the spraying apparatus. If the sets of apertures 25*d*, 25*e* comprise a plurality of apertures, the apertures of each set are preferably arranged in a linear array with successive product apertures of each set having a decreasing (or increasing) diameter whereby increasingly larger product apertures will result in increasingly less diluted (i.e., more concentrated) flows of product being discharged from the sprayer apparatus, and vice versa.

Figure 5A:
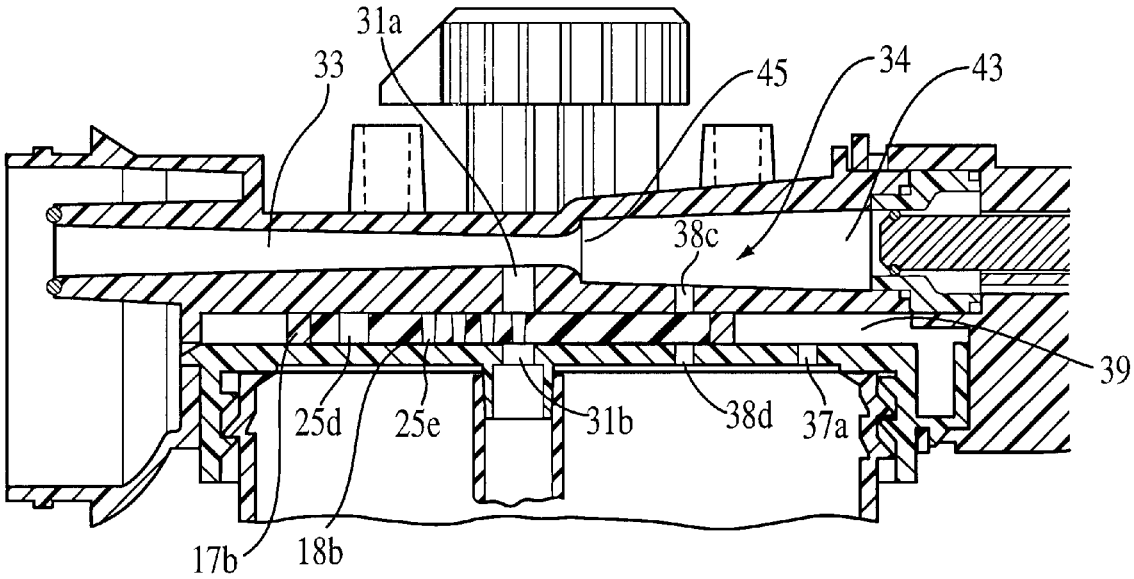
FIGS. 5A, 5B and 5C are top views of a further preferred embodiment the sprayer apparatus of the present invention depicting a slideable control means in several positions associated with dispensing either liquid or powdered product from the apparatus.

When slideable control plate 17*b* is in a first position as shown in FIG. 5A, one of the product apertures 25*e* is aligned with the container outlet ports 31*a* and 31*b*. In this position, as previously discussed in connection with FIG. 3A, vent channel 39 communicates with the ambient atmosphere and may be selectively manipulated to permit atmospheric air to enter the container inlet port 37*a*.

In this first position, which "first position" refers generally to one of several orientations into which the slideable control member 17*b* may be selectively disposed in order to dispense relatively low viscosity liquid product through a chosen one of the first set product apertures 25*e* to effect a desired dilution ratio, water from a hose (not shown) flows through the posterior flow passage 43 of the carrier stream flow passage 34, through a flow passage constriction 45, and then through anterior flow passage 33. When the water passes through constriction 45 and the anterior flow passage 33, it passes over the selected product aperture 25*e* at high velocity, thereby creating a negative pressure gradient or venturi which causes liquid chemical product in the interior of the container 11 to be drawn under suction through the product delivery tube 35, container outlet ports 31*a* and 31*b* and the selected product aperture 25*e*. The product is then diluted to the desired concentration by the carrier fluid stream passing through the anterior flow passage 33, as selected by choosing the corresponding product aperture 25*e*, and is sprayed onto an appropriate target. Again, while liquid chemical is being drawn from the container 11, atmospheric air simultaneously enters vent channel 39 and container inlet port 37*a* to displace the discharged liquid chemical and prevent collapse of the walls of the container.

When it is desired to dispense high viscosity liquid, gelatinous materials or powdered solid product from the apparatus, the user may simply detach the liquidbearing container and attach a container 11 holding high viscosity liquid, gelatinous substance or dry product to the sprayer head 1 and proceed as follows. In a second position shown in FIG. 5C (the "second position" referring generally to one of several orientations into which the slideable control member 17*b* may be selectively disposed in order to dispense a mixture of carrier fluid and dissolved or suspended product through a chosen one of the second set of product apertures 25*d* to effect a desired dilution ratio), slideable control plate 17*b* is positioned such that one of a second set of product apertures 25*d* is aligned with the container outlet ports 31*a* and 31*b*.

Simultaneously, a selected one of the product apertures 25*e* acting as a carrier stream inlet port of the slideable control member is brought into alignment with the container inlet ports 38*c* and 38*d* whereby a portion of the carrier stream in posterior flow passage 43 (by virtue of backpressure created by the presence of flow passage constriction 45) is diverted into container 11 through cooperation of the appropriate carrier stream inlet port 25*e* and the container inlet ports 38*c* and 38*d*. Once in the container, the carrier stream fluid mixes with the product in the container 11, thereby forming a solution or a suspension.

The undiverted remainder of the carrier stream fluid passes through the flow passage constriction 45 and through the anterior flow passage 33. Again, as the carrier stream fluid passes through the anterior flow passage, it passes over the selected product aperture of the second set of product apertures 25*d*, thereby creating a negative pressure gradient and causing the product solution in the interior of the container 11 to be drawn through product delivery tube 35, container outlet ports 31*a* and 31*b* and the selected product aperture 25*d* whereupon it is then diluted by the carrier stream in the anterior flow passage 33 and sprayed onto a target. As previously mentioned, a portion of the carrier stream fluid is simultaneously diverted into the container to enhance displacement of the product therefrom.

Figure 5B:
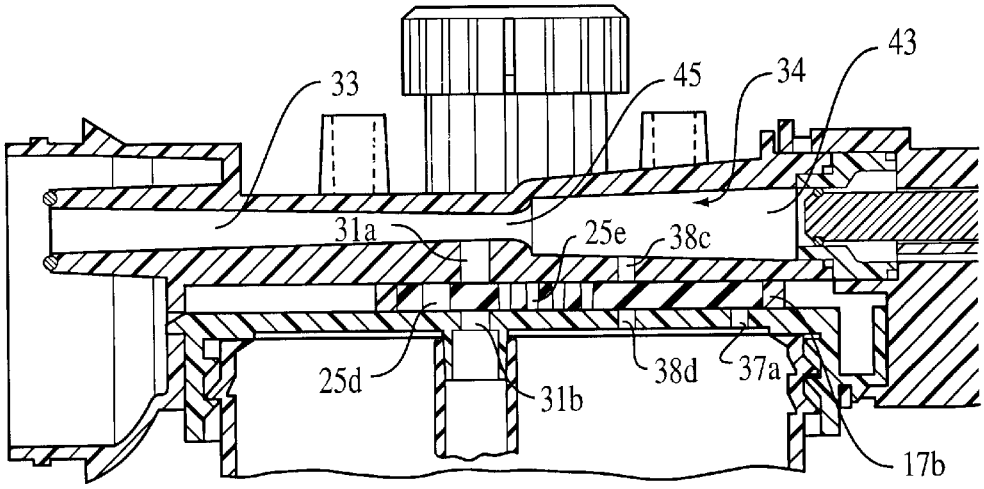
Figure 5C:
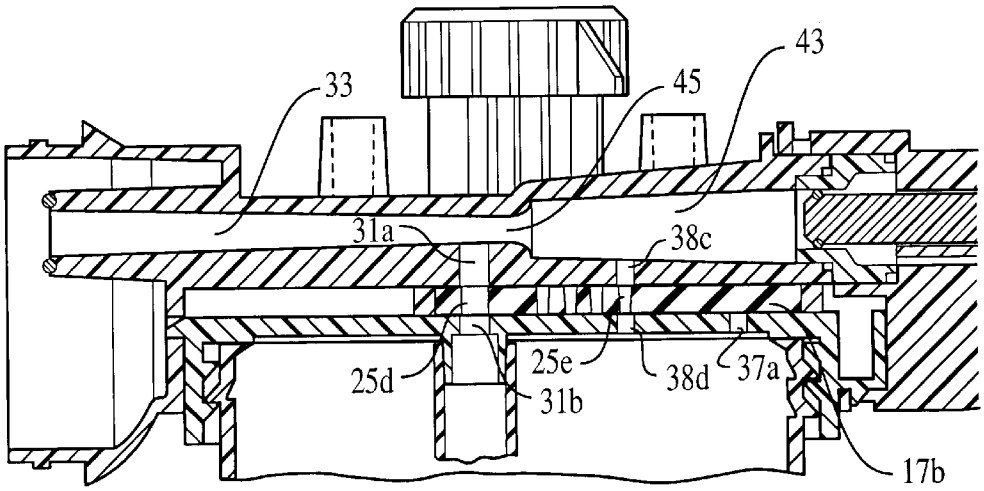

As shown in FIG. 5B ("OFF" position), none of the first and second sets of product apertures 25*d*, 25*e* is in communicative connection with either the container outlet ports 31*a* or 31*b* or the container inlet ports 37*a*, 38*a* or 38*b*. Indeed, the container outlet ports 31*a* and 31*b* and the container inlet ports 37*a*, 38*a* or 38*b* are sealed by means of the elongated seal member 18*b* of the control plate 17*b*. The carrier stream fluid therefore passes directly through the posterior flow passage 43, the flow passage constriction 45, the anterior flow passage 33, and out of the sprayer without mixing with any product from the container 11. Substantially pure carrier stream fluid is therefore sprayed without removing container 11.

Figure 9:
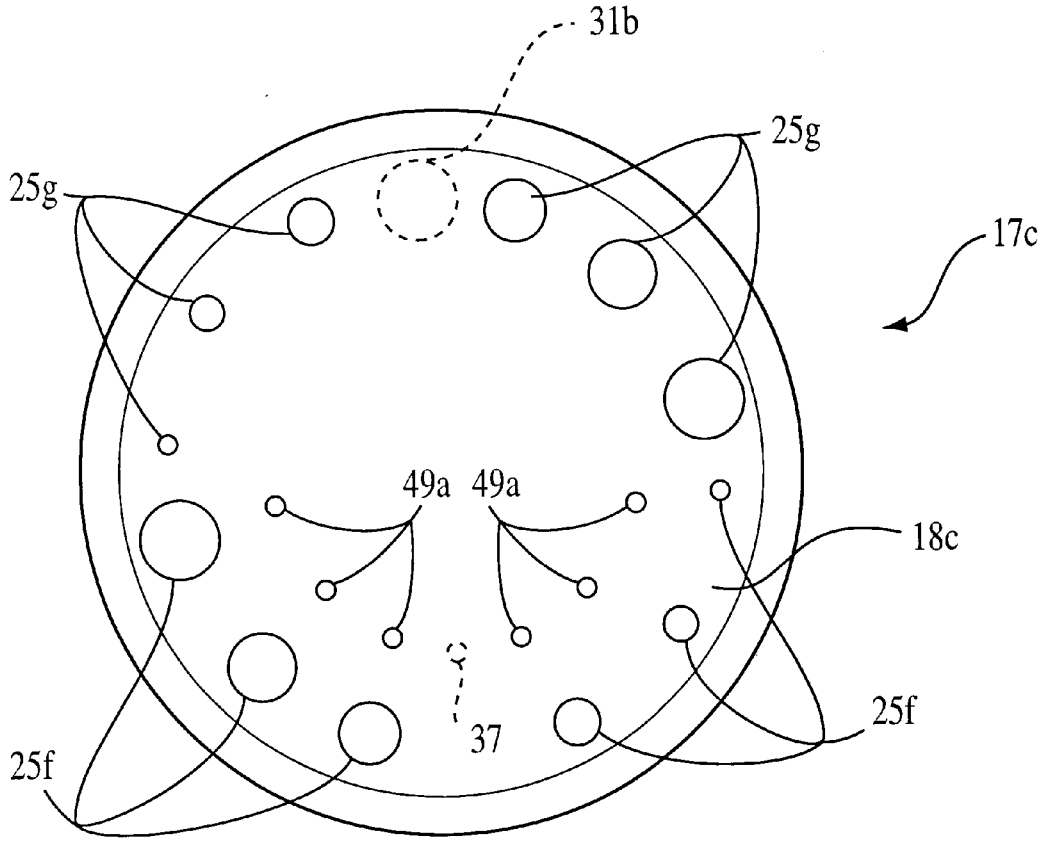
FIG. 9 is a top plan view of an alternative, rotatable control plate.

According to another embodiment of the present invention as depicted in FIG. 9, the sprayer apparatus is equipped with control means constructed in the form of a rotatable control disk 17*c*. The disk 17*c* may be dimensioned such that it can be physically grasped at its circumference by a user and rotated. Alternatively, the circumference of the disk may be provided with gear teeth for meshingly engaging, for example, with a drive gear such as toothed gear wheel 21 discussed above, whereby the disk may be rotated by rotation of a suitable control knob operatively attached to the drive gear. Like slideable control members 17, 17*a* and 17*b*, control disc 17*c* includes an opening for receiving a seal member 18*c* having product apertures. Disposed on the rotatable control disk 17*c* is at least a first set of angularly spaced product apertures 25*f*. Preferably, the disk also includes a second set of product apertures 25*g* as well as a set carrier stream inlet ports 49*a* (wherein each set of product apertures 25*d*, 25*e* and carrier stream inlet ports 49*a* may comprise one or, more preferably a plurality of apertures) which function similarly to their counterpart product apertures and carrier stream inlet ports discussed above in connection with FIGS. 3A–3C, 4A–4C and 5A–5C. It will be understood that product apertures 25*f*, 25*g* have aperture openings of differing sizes to effect various dilution ratios of product, either relatively low viscosity product, high viscosity liquid product, gelatinous product, or powdered solid product, that is to be dispensed by a sprayer apparatus equipped with the disk 17*c*. For the present discussion, product apertures 25*f* may be conceptualized as the functional equivalents of the liquid dispensing product apertures 25*a* (or 25b) of FIGS. 3A–3C, whereas apertures 25*g* may be viewed as corresponding to the product apertures 25*c* of FIGS. 4A–4C. Likewise, carrier stream inlet ports 49*a* are substantially similar to the earlier described ports 49 and are radially displaced from and correspond in number and angular spacing to product apertures 25g. The control disk 17*c* thus may be selectively rotated whereby each of the product apertures may be selectively positioned to afford fluid communication with the container outlet ports 31*a* and 31*b* (shown in phantom line) and, where appropriate, the carrier stream inlet ports 49 may be likewise aligned with the container inlet ports 37 also shown in phantom line). As will be appreciated, therefore, by rotating rotatable control disk 17*c*, the several modalities variously described with respect to the slideable control plates 17, 17*a* and/or 17*b*, supra (i.e., relatively low viscosity liquid product dispensing, high viscosity liquid product, gelatinous material or dry product dispensing, substantially pure carrier stream dispensing, or no dispensing) are possible.

In FIGS. 13–15, an embodiment is illustrated which allows simultaneous mixing of the contents of two containers with a single carrier stream. In this embodiment, a pair of selected product apertures are brought into cooperation with two pairs of container outlet ports. The nozzle portion of the cap member includes two carrier stream passages-each one corresponding to one of the pairs of container outlet ports. The lower port of each pair of outlet ports is connected to the upper end of a product delivery tube. Each product delivery tube extends downwardly into the internal cavity of a container. Control means includes a toothed rack 19*a* located interiorly of one end of control member 17*d* for engaging gear wheel 21. Sealing member 18*d* includes two sets of apertures, one set corresponding to each container and carrier stream passage.

Preferably, sprayer head 2 is provided in all embodiments with an indicator (not shown) to notify the user of the functional disposition of sprayer head (i.e., (1) spraying relatively low viscosity liquid product in one of possibly several dilution ratios, or (2) spraying high viscosity liquid product, gelatinous product or dry powdered product in one of possibly several dilution ratios.)

Alternatively, product container 11 may be collapsible precluding the need for vent ports. Thus, the container would collapse as product is discharged.

Further, each product apertures in the seal members may be bounded by an annular seal ring downwardly depending from the lower surface of the seal member to optimize venturi created in the anterior flow passage 33 (shown in FIG. 15.)

If not otherwise stated herein, it may be assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein.

Although the invention has been described in detail for the purpose of illustration, it is to be understood that such detail is solely for that purpose and that numerous modifications, alterations and changes can be made therein by those skilled in the art without departing from the spirit and scope of the invention except as it may be limited by the claims. All changes which come within the meaning and range of equivalency of the claims are to be embraced within their scope.

What is claimed is:

1. A sprayer head comprising:

a cap member including;

first means for attaching said cap member to a source of carrier stream fluid;

second means for attaching said cap member to a container containing a product to be diluted by the carrier stream, said second attaching means having a first adjacent surface;

a nozzle having at least one carrier stream flow passage for receiving a flow of carrier stream fluid, said nozzle having a second adjacent surface adjacent to said first adjacent surface; and outlet means comprising first and second opposing outlet ports communicable with said at least one carrier stream flow passage and the container for delivering product from the container to said carrier stream flow passage, said first outlet port extending through said first adjacent surface and said second outlet port extending through said second adjacent surface; and control means for controlling fluid communication between said cap member and the container, said control means including a control member having a seal member for precluding leakage of a fluid flow through said first and second outlet ports, said seal member including:

a quantity of sealing material being adapted to provide an airtight seal between said first and second adjacent surfaces;

said quantity of sealing material including a first body surface for sealing engagement with said first adjacent surface;

said quantity of sealing material including a second body surface for sealing engagement with said second adjacent surface; and a plurality of apertures extending through said quantity of sealing material between said first and second body surfaces and at least one of said plurality of apertures adapted for selective alignment with said first and second outlet ports;

wherein the control member is adapted for movement between a first position in which one of said plurality of apertures is aligned with said first and second outlet ports and a second position in which said one of said plurality of apertures is out of alignment with said first and second outlet ports;

wherein each of said plurality of apertures extends diagonally from said first adjacent surface to said second adjacent surface.

2. A sprayer head comprising:

a cap member including:

first means for attaching said cap member to a source of carrier stream fluid;

second means for attaching said cap member to a container containing a product to be diluted by the carrier stream, said second attaching means having a first adjacent surface;

a nozzle having at least one carrier stream flow passage for receiving a flow of carrier stream fluid, said nozzle having a second adjacent surface adjacent to said first adjacent surface; and outlet means comprising first and second opposing outlet ports communicable with said at least one carrier stream flow passage and the container for delivering product from the container to said carrier stream flow passage, said first outlet port extending through said first adjacent surface and said second outlet port extending through said second adjacent surface; and control means for controlling fluid communication between said cap member and the container, said control means including a control member having a seal member for precluding leakage of a fluid flow through said first and second outlet ports, said seal member including:

a quantity of sealing material being adapted to provide an airtight seal between said first and second adjacent surfaces;

said quantity of sealing material including a first body surface for sealing engagement with said first adjacent surface;

said quantity of sealing material including a second body surface for sealing engagement with said second adjacent surface; and a plurality of apertures extending through said quantity of sealing material between said first and second body surfaces and at least one of said plurality of apertures adapted for selective alignment with said first and second outlet ports;

wherein the control member is adapted for movement between a first position in which one of said plurality of apertures is aligned with said first and second outlet ports and a second position in which said one of said plurality of apertures is out of alignment with said first and second outlet ports;

wherein said seal member further comprises at least one seal portion disposed on each of said first and second body surfaces and adapted for selective sealing engagement with a respective one of said first and second outlet ports;

said cap member further comprising carrier stream fluid inlet means communicable with said carrier stream flow passage for delivering a portion of the carrier stream fluid to the container;

wherein said carrier stream fluid inlet means comprises first and second opposing inlet ports communicable with said at least one carrier stream passage and the container for delivering a portion of the carrier stream fluid to the container, said first inlet port extending through said first adjacent surface and said second inlet port extending through said second adjacent surface, such that when said control member is disposed in said first position, a second one of said plurality of apertures is aligned with said first and second inlet ports and delivers a part of the carrier stream to the container, whereby the portion of the carrier stream delivered to the container mixes with the product and the mixed carrier stream and product is drawn from the container and diluted by the carrier stream in said at least one carrier stream flow passage whereupon the diluted carrier stream and product mixture is discharged from the sprayer head.

3. A sprayer head comprising:

a cap member including:

first means for attaching said cap member to a source of carrier stream fluid;

second means for attaching said cap member to a container containing a product to be diluted by the carrier stream, said second attaching means having a first adjacent surface;

a nozzle having at least one carrier stream flow passage for receiving a flow of carrier stream fluid, said nozzle having a second adjacent surface adjacent to said first adjacent surface; and outlet means comprising first and second opposing outlet ports communicable with said at least one carrier stream flow passage and the container for delivering product from the container to said carrier stream flow passage, said first outlet port extending through said first adjacent surface and said second outlet port extending through said second adjacent surface; and control means for controlling fluid communication between said cap member and the container, said control means including a control member having a seal member for precluding leakage of a fluid flow through said first and second outlet ports, said seal member including:

a quantity of sealing material being adapted to provide an airtight seal between said first and second adjacent surfaces;

said quantity of sealing material including a first body surface for sealing engagement with said first adjacent surface;

said quantity of sealing material including a second body surface for sealing engagement with said second adjacent surface; and a plurality of apertures extending through said quantity of sealing material between said first and second body surfaces and at least one of said plurality of apertures adapted for selective alignment with said first and second outlet ports;

wherein the control member is adapted for movement between a first position in which one of said plurality of apertures is aligned with said first and second outlet ports and a second position in which said one of said plurality of apertures is out of alignment with said first and second outlet ports;

wherein said seal member further comprises at least one seal portion disposed on each of said first and second body surfaces and adapted for selective sealing engagement with a respective one of said first and second outlet ports;

said cap member further comprising carrier stream fluid inlet means communicable with said carrier stream flow passage for delivering a portion of the carrier stream fluid to the container;

wherein said carrier stream fluid inlet means comprises first and second opposing inlet ports communicable with said at least one carrier stream passage and the container for delivering a portion of the carrier stream fluid to the container, said first inlet port extending through said first adjacent surface and said second inlet port extending through said second adjacent surface, such that when said control member is disposed in said first position, a second one of said plurality of apertures is aligned with said first and second inlet ports and delivers a portion of the carrier stream to the container, whereby the portion of the carrier stream delivered to the container mixes with the product and the mixed carrier stream and product is drawn from the container and diluted by the carrier stream in said at least one carrier stream flow passage whereupon the diluted carrier stream and product mixture is discharged from the sprayer head, and when said control member is disposed in said second position, a respective seal portion seals said carrier stream inlet ports.

4. A sprayer head comprising:

a cap member including:

first means for attaching said cap member to a source of carrier stream fluid;

second means for attaching said cap member to a container containing a product to be diluted by the carrier stream, said second attaching means having a first adjacent surface;

a nozzle having at least one carrier stream flow passage for receiving a flow of carrier stream fluid, said nozzle having a second adjacent surface adjacent to said first adjacent surface; and outlet means comprising first and second opposing outlet ports communicable with said at least one carrier stream flow passage and the container for delivering product from the container to said carrier stream flow passage, said first outlet port extending through said first adjacent surface and said second outlet port extending through said second adjacent surface; and control means for controlling fluid communication between said cap member and the container, said control means including a control member having a seal member for precluding leakage of a fluid flow through said first and second outlet ports, said seal member including:

a quantity of sealing material being adapted to provide an airtight seal between said first and second adjacent surfaces;

said quantity of sealing material including a first body surface for sealing engagement with said first adjacent surface;

said quantity of sealing material including a second body surface for sealing engagement with said second adjacent surface; and a plurality of apertures extending through said quantity of sealing material between said first and second body surfaces and at least one of said plurality of apertures adapted for selective alignment with said first and second outlet ports;

wherein the control member is adapted for movement between a first position in which one of said plurality of apertures is aligned with said first and second outlet ports and a second position in which said one of said plurality of apertures is out of alignment with said first and second outlet ports;

wherein said seal member further comprises at least one seal portion disposed on each of said first and second body surfaces and adapted for selective sealing engagement with a respective one of said first and second outlet ports;

said sprayer head further comprising:

air inlet means communicable with ambient atmosphere for delivering ambient air to the container; and carrier stream fluid inlet means communicable with said at least one carrier stream flow passage for delivering a portion of the carrier stream fluid to the container;

wherein said carrier stream fluid inlet means comprises first and second opposing inlet ports communicable with said at least one carrier stream passage and the container for delivering a portion of the carrier stream fluid to the container, said first inlet port extending through said first adjacent surface and said second inlet port extending through said second adjacent surface, such that when said control member is disposed in a third position, a second one of said plurality of apertures is aligned with said first and second inlet ports and delivers a portion of the carrier stream to the container, whereby the portion of the carrier stream delivered to the container mixes with the product and the mixed carrier stream and product is drawn from the container and diluted by the carrier stream in said at least one carrier stream flow passage whereupon the diluted carrier stream and product mixture is discharged from the sprayer head.

5. A sprayer apparatus comprising:

a container containing product to be diluted by a carrier stream fluid;

a cap member including:

first means for attaching said cap member to a source of carrier stream fluid;

second means for attaching said cap member to said container, said second attaching means having a first adjacent surface;

a nozzle having at least one carrier stream flow passage for receiving a flow of carrier stream fluid, said nozzle having a second adjacent surface adjacent to said first adjacent surface; and outlet means comprising first and second opposing outlet ports communicable with said at least one carrier stream passage and said container for delivering product from said container to said at least one carrier stream flow passage, said first outlet port extending through said first adjacent surface and said second outlet port extending through said second adjacent surface; and control means for controlling fluid communication between said cap member and the container, said control means including a control member having a seal member for precluding leakage of a fluid flow through said first and second outlet ports, said seal member including:

a quantity of sealing material being adapted to provide an airtight seal between said first and second adjacent surfaces;

said quantity of sealing material including a first body surface for providing sealing engagement with said first adjacent surface;

said quantity of sealing material including a second body surface for providing sealing engagement with said second adjacent surface; and a plurality of apertures extending through said quantity of sealing material between said first and second body surfaces and at least one of said apertures being adapted for selective alignment with said first and second outlet ports;

wherein the control member is adapted for movement between a first position in which one to said plurality of apertures is aligned with said first and second outlet ports and a second position in which said one of said plurality of apertures is out of alignment with said first and second outlet ports;

wherein each of said plurality of apertures extends diagonally from said first adjacent surface to said second adjacent surface.

6. A sprayer apparatus comprising:

a container containing product to be diluted by a carrier stream fluid;

a cap member including:

first means for attaching said cap member to a source of carrier stream fluid;

second means for attaching said cap member to said container, said second attaching means having a first adjacent surface;

a nozzle having at least one carrier stream flow passage for receiving a flow of carrier stream fluid, said nozzle having a second adjacent surface adjacent to said first adjacent surface; and outlet means comprising first and second opposing outlet ports communicable with said at least one carrier stream passage and said container for delivering product from said container to said at least one carrier stream flow passage, said first outlet port extending through said first adjacent surface and said second outlet port extending through said second adjacent surface; and control means for controlling fluid communication between said cap member and the container, said control means including a control member having a seal member for precluding leakage of a fluid flow through said first and second outlet ports, said seal member including:

a quantity of sealing material being adapted to provide an airtight seal between said first and second adjacent surfaces;

said quantity of sealing material including a first body surface for providing sealing engagement with said first adjacent surface;

said quantity of sealing material including a second body surface for providing sealing engagement with said second adjacent surface; and a plurality of apertures extending through said quantity of sealing material between said first and second body surfaces and at least one of said apertures being adapted for selective alignment with said first and second outlet ports;

wherein the control member is adapted for movement between a first position in which one of said plurality of apertures is aligned with said first and second outlet ports and a second position in which said one of said plurality of apertures is out of alignment with said first and second outlet ports;

said sprayer apparatus further comprising carrier stream fluid inlet means communicable with said at least one carrier stream flow passage for delivering a portion of the carrier stream fluid to said container;

wherein said carrier stream fluid inlet means comprises first and second opposing inlet ports communicable with said at least one carrier stream passage and said container for delivering a portion of the carrier stream fluid to said container, said first inlet port extending through said first adjacent surface and said second inlet port extending through said second adjacent surface, such that when said control member is disposed in said first position, a second one of said plurality of apertures is aligned with said first and second inlet ports and delivers a port of the carrier stream to said container, whereby the portion of the carrier stream delivered to said container mixes with the product and the mixed carrier stream and product is drawn from said container and diluted by the carrier stream in said at least one carrier stream flow passage whereupon the diluted carrier stream and product mixture is discharged from the sprayer apparatus.

7. A sprayer apparatus comprising:

a container containing product to be diluted by a carrier stream fluid;

a cap member including:

first means for attaching said cap member to a source of carrier stream fluid;

second means for attaching said cap member to said container, said second attaching means having a first adjacent surface;

a nozzle having at least one carrier stream flow passage for receiving a flow of carrier stream fluid, said nozzle having a second adjacent surface adjacent to said first adjacent surface; and outlet means comprising first and second opposing outlet ports communicable with said at least one carrier stream passage and said container for delivering product from said container to said at least one carrier stream flow passage, said first outlet port extending through said first adjacent surface and said second outlet port extending through said second adjacent surface; and control means for controlling fluid communication between said cap member and the container, said control means including a control member having a seal member for precluding leakage of a fluid flow through said first and second outlet ports, said seal member including:

a quantity of sealing material being adapted to provide an airtight seal between said first and second adjacent surfaces;

said quantity of sealing material including a first body surface for providing sealing engagement with said first adjacent surface;

said quantity of sealing material including a second body surface for providing sealing engagement with said second adjacent surface; and a plurality of apertures extending through said quantity of sealing material between said first and second body surfaces and at least one of said apertures being adapted for selective alignment with said first and second outlet ports;

wherein the control member is adapted for movement between a first position in which one of said plurality of apertures is aligned with said first and second outlet ports and a second position in which said one of said plurality of apertures is out of alignment with said first and second outlet ports;

said sprayer apparatus further comprising carrier stream fluid inlet means communicable with said at least one carrier stream flow passage for delivering a portion of the carrier stream fluid to said container;

wherein said carrier stream fluid inlet means comprises first and second opposing inlet ports communicable with said at least one carrier stream passage and said container for delivering a portion of the carrier stream fluid to said container, said first inlet port extending through said first adjacent surface and said second inlet port extending through said second adjacent surface, such that when said control member is disposed in said first position, a second one of said plurality of apertures is aligned with said first and second inlet ports and delivers a portion of the carrier stream to said container, whereby the portion of the carrier stream delivered to said container mixes with the product and the mixed carrier stream and product is drawn from said container and diluted by the carrier stream in said at least one carrier stream flow passage whereupon the diluted carrier stream and product mixture is discharged from the sprayer apparatus, and when said control member is disposed in said second position, a respective seal portion seals said carrier stream inlet ports.

* * * * *